US005080084A

United States Patent [19]

Kendall et al.

[11] Patent Number: 5,080,084

[45] Date of Patent: Jan. 14, 1992

[54] LIGHT SAVER PEEP SIGHT FOR ARCHERS

[76] Inventors: Robert M. Kendall, 1216 S. 48th St., Baltimore, Md. 21222; William R. Casey, 714 Bradford La., Abingdon, Md. 21009

[21] Appl. No.: 600,607

[22] Filed: Oct. 19, 1990

[51] Int. Cl.[5] ..... F41B 5/00

[52] U.S. Cl. ..... 124/87; 124/90

[58] Field of Search ..... 124/87, 90, 23.1; 33/265, 241, 242, 243

[56] References Cited

U.S. PATENT DOCUMENTS

| | | | |
|---|---|---|---|
| 2,430,469 | 11/1947 | Karnes | 33/241 |
| 2,488,836 | 11/1949 | Sweetman | 33/241 |
| 3,410,644 | 11/1968 | McLendon | 124/87 X |
| 3,678,590 | 7/1972 | Hayward | 33/241 |
| 3,703,771 | 11/1972 | Saunders | 33/265 |
| 3,945,127 | 3/1976 | Spencer | 33/265 |
| 4,011,853 | 3/1977 | Fletcher | 124/87 |
| 4,934,332 | 6/1990 | Scherz | 33/265 X |
| 4,977,677 | 12/1990 | Troescher, Jr. | 33/241 X |
| 4,978,254 | 12/1990 | Langlois et al. | 407/33 |

*Primary Examiner*—Peter M. Cuomo
*Assistant Examiner*—Jeffrey L. Thompson
*Attorney, Agent, or Firm*—Leonard Bloom

[57] ABSTRACT

A peep sight for use with an archer's bow is fabricated from a non-opaque material to which a light enhancing color has been added. The available light is thereby intensified in the peep sight so that visibility is increased at low light levels. The peep sight has four notched corners for mounting the peep sight on the bowstring. When so mounted the strands of the bowstring do not obstruct the vision of the archer. Furthermore, the peep hole in the peep sight may be angled to increase the field of vision of the archer. A dark annular ledge is provided about the peep hole to further improve viewing definition through the peep sight. In a second embodiment, a source of energy, and a light source connected to the peep sight by a fiber optic cord also provides a peep sight for improved visibility for the archer.

23 Claims, 6 Drawing Sheets

LIGHT SAVER PEEP SIGHT FOR ARCHERS

FIELD OF THE INVENTION

The following invention relates to a peep sight for use with an archer's bow and more particularly to a peep sight made of a non-opaque material and having a color imparted thereto for intensifying the light about a peep hole formed in the peep sight.

BACKGROUND OF THE INVENTION

Archery is an ancient art in which many improvements have been made over thousands of years. In recent years, peep sights have been designed to improve the accuracy of aiming the arrow to correct for distance and other factors. Some of these improvements have been directed at improved sighting by alignment of the sight with respect to the archer's head as in U.S. Pat. No. 3,942,507 issued to Opal. U.S. Pat. No. 4,454,857 issued to Miller et al. and U.S. Pat. No. 4,895,129 issued to Hedgpeth are directed to a peep sight adjustable along the bowstring which is unaffected by rotation of the peep sight. The secure mounting of the peep sight in the bowstring is the object of U.S. Pat. No. 4,656,747 issued to Troncoso. Other U.S. Patents of which I am aware which are directed to improved peep sights and sighting devices are:

| Inventor(s) | U.S. Pat. No. |
|---|---|
| Stonecipher | 3,199,502 |
| Roloff et al. | 3,389,695 |
| McLendon | 3,410,644 |
| Sofield | 3,703,770 |
| Chesnick | 3,859,733 |
| Fletcher | 4,011,853 |
| Ernstsen | 4,860,458 |

While all of these disclosures have been directed to various means of improving the sighting of a bow, the importance of the amount of light available in the peep sight has been virtually overlooked. U.S. Pat. No. 3,703,771 issued to Saunders discloses a means to minimize light reflection from the surface of the face of the body surrounding the peep post. The light baffle means comprises a grating which serves as a light diffracting structure. U.S. Pat. No. 4,625,422 issued to Carlson recognizes that additional light is needed in the peep sight and discloses a large central aperture to define a window and an aiming dot secured within the central portion of the window. Neither of these references address the issue of enhancing the available light. Saunders is concerned with light reflection, and the grating substantially reduces the available light because the design of the peep sight has a face which reflects light. Carlson simply enlarges the window. Many of the other cited references actually decrease visibility through the peep sight by virtue of restricting the size of the opening and/or inserting optical lenses in the openings or use of opaque materials for construction of the peep sight. Further, many peep sights are mounted in such a manner that the bowstring strands obstruct the vision of the archer.

Thus, there remains a need to provide a peep sight which is designed for efficient mounting on the bowstring and is fabricated to effectively utilize all the available light to enhance the light so that the archer can use the bow even when a limited amount of light is available.

SUMMARY OF THE INVENTION

A principal object of the present invention is to provide a peep sight for an archer's bow which makes optimum use of the available light.

It is another object of the present invention to provide a peep sight which has a shape which can be mounted on the bowstring to reduce obstructions to the archer's field of vision.

It is still another object of the present invention to provide a peep sight fabricated from a colored transparent material which effectively utilizes available light.

It is yet another object of the present invention to provide a limited opaque area around the viewing window to provide greater viewer definition without impairing the light transmission of the material from which the peep sight is fabricated.

It is a further object of the present invention to provide an illuminated fiber optic cord connected to the peep sight to improve viewing window definition.

In accordance with the teachings of the present invention, there is disclosed a peep sight used in combination with an archer's bow. The bow has a pair of limb portions provided with a bowstring therebetween, the bowstring having at least one strand. The peep sight is a unitary article made from a substantially transparent non-opaque material and has a viewing window formed therein. The sight is substantially square and is provided with four corners. Each corner has a slot formed therein. The bowstring has at least four strands, one for each slot, thereby mounting the sight on the strands. The sight has a pair of substantially flat faces and further has a pair of annular beveled surfaces joining the viewing window to the respective faces of the sight, thereby reducing distortion when the sight is used. The viewing window has a peep hole formed substantially centrally of the sight and between the faces thereof. The sight is provided with an annular ledge between the peep hole and one of the annular beveled surfaces on the sight. The annular ledge is provided with a pigment impregnation. The sight has means formed integrally therewith for transmitting the light entering the sight in towards the viewing window, such that the available light is transmitted towards the viewing window for improved viewing window definition, especially where the available light is substantially restricted.

In a preferred embodiment, the peep sight has a color imparted thereto such that the available light is absorbed at a first wave length and emitted at a second wave length thereby intensifying the light about the peep hole.

In another preferred embodiment, there is disclosed a peep sight used in combination with an archer's bow. The archer's bow has limb portions and a bowstring extends between the limb portions. The peep sight is a unitary article made from a non-opaque material and has a viewing window formed therein. Means are provided for mounting the peep sight on the bowstring. A source of energy is connected to the bow and a light source is connected to the source of energy. A fiber optic cord having a first end and a second end is provided. The first end of the fiber optic cord is attached to the peep sight and the second end of the fiber optic cord is attached to the light source. When the light source is energized, light is transmitted through the fiber optic cord to illuminate the peep sight for improved viewing window definition.

These and other objects of the present invention will become apparent from a reading of the following specification, taken in conjunction with the enclosed drawings.

DESCRIPTION OF THE PREFERRED EMBODIMENTS

Figure 5:
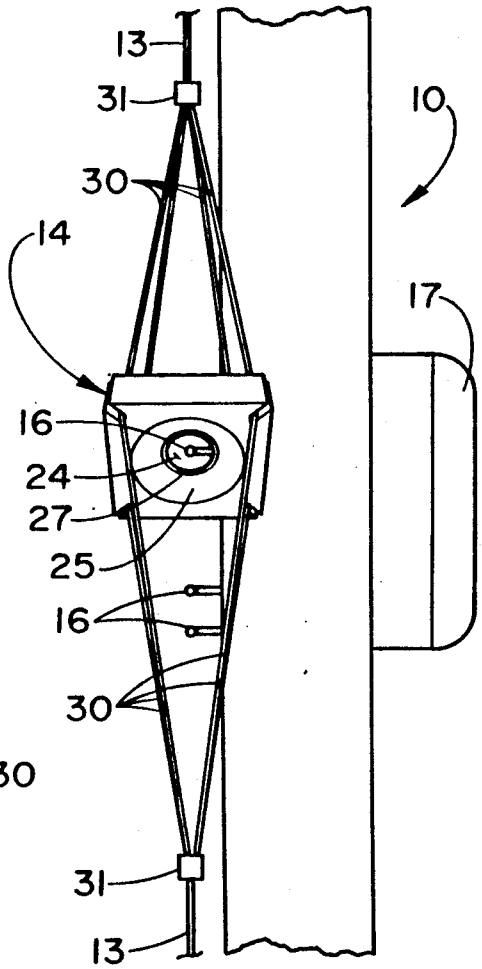
FIG. 5 is a cross-section taken across the lines 5—5 of FIG. 3.
Figure 2:
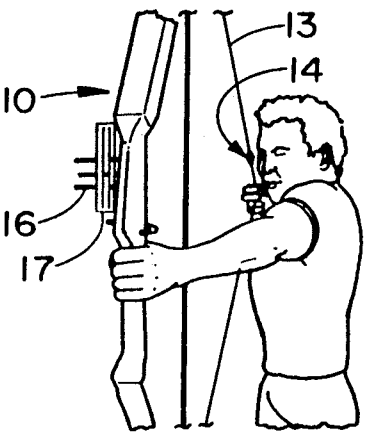
FIG. 2 is a front perspective view of an archer using a bow with the peep sight of the present invention.

Referring now to the drawings, an archer's bow 10 is provided with an upper limb portion 11 and a lower limb portion 12. A bowstring 13 is connected to the limb portions 11 and 12 and extends between. A peep sight 14 is mounted in the bowstring 13 at a point between the upper limb portion 11 and the nocking point 15 at which the bowstring 13 engages the shaft of an arrow (not shown). The peep sight 14 is so mounted that when the archer holds the bow 10 and draws back on the bowstring 13, the peep sight 14 is positioned adjacent to the archer's check and immediately in front of the archer's eye (FIGS. 1-4). This position is critical for the archer to properly sight through the peep sight 14 to align the sight pins 16 in the bowsight 17 so that the arrow may reach the target (FIG. 5). This sighting is dependent on the ambient lighting and becomes more difficult when lighting is restricted such as in the early morning and later afternoon hours.

Figure 4:
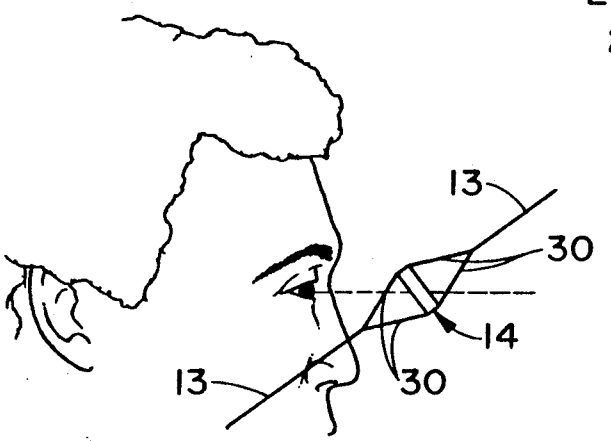
FIG. 4 is an enlarged side view of an archer sighting through the peep sight of the present invention.
Figure 1:
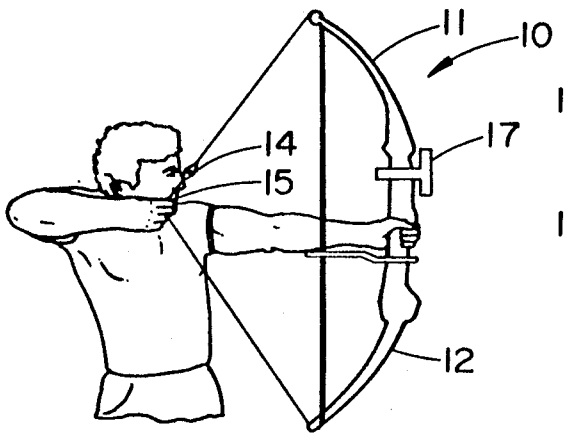
FIG. 1 is a right side perspective view of an archer using a bow with the peep sight of the present invention.
Figure 3:
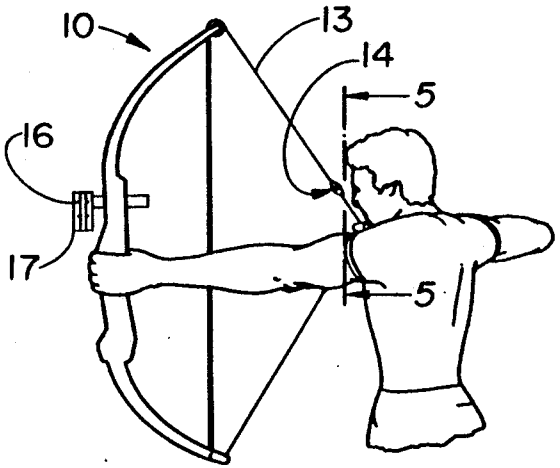
FIG. 3 is a left side perspective view of an archer using a bow with the peep sight of the present invention.
Figure 8:
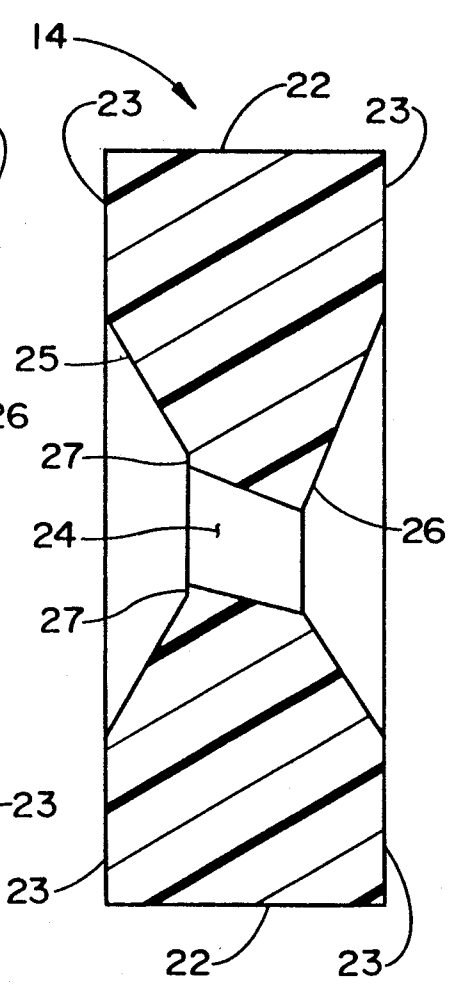
FIG. 8 is a cross-section taken across the lines 7—7 of FIG. 6 in which the viewing window is angled.
Figure 7:
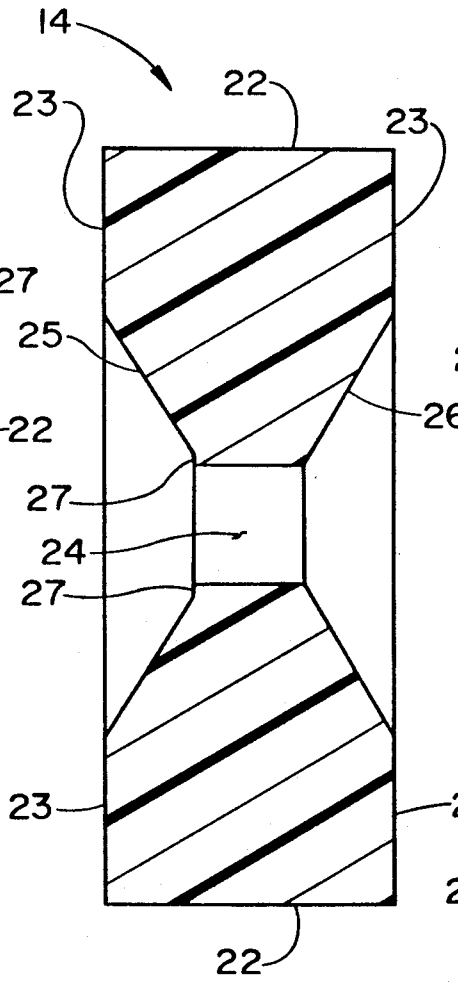
FIG. 7 is a cross-section taken across the lines 7—7 of FIG. 6.
Figure 6:
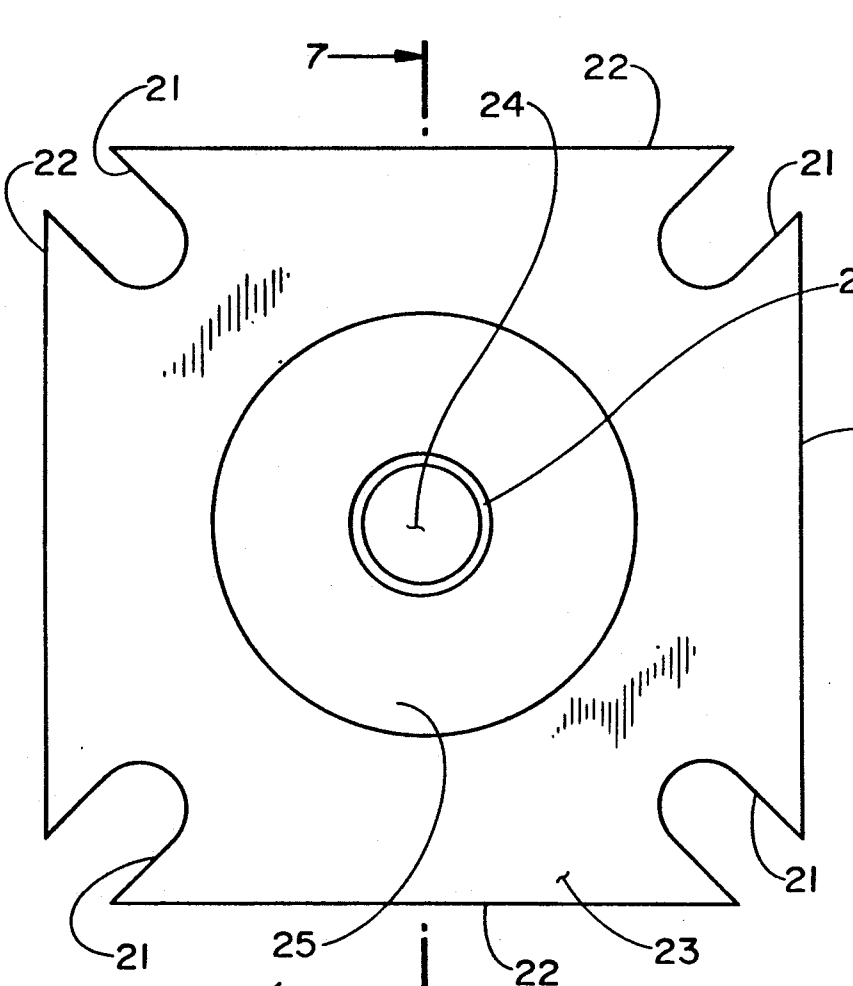
FIG. 6 is a top plain view of the peep sight of the present invention.
Figure 9:
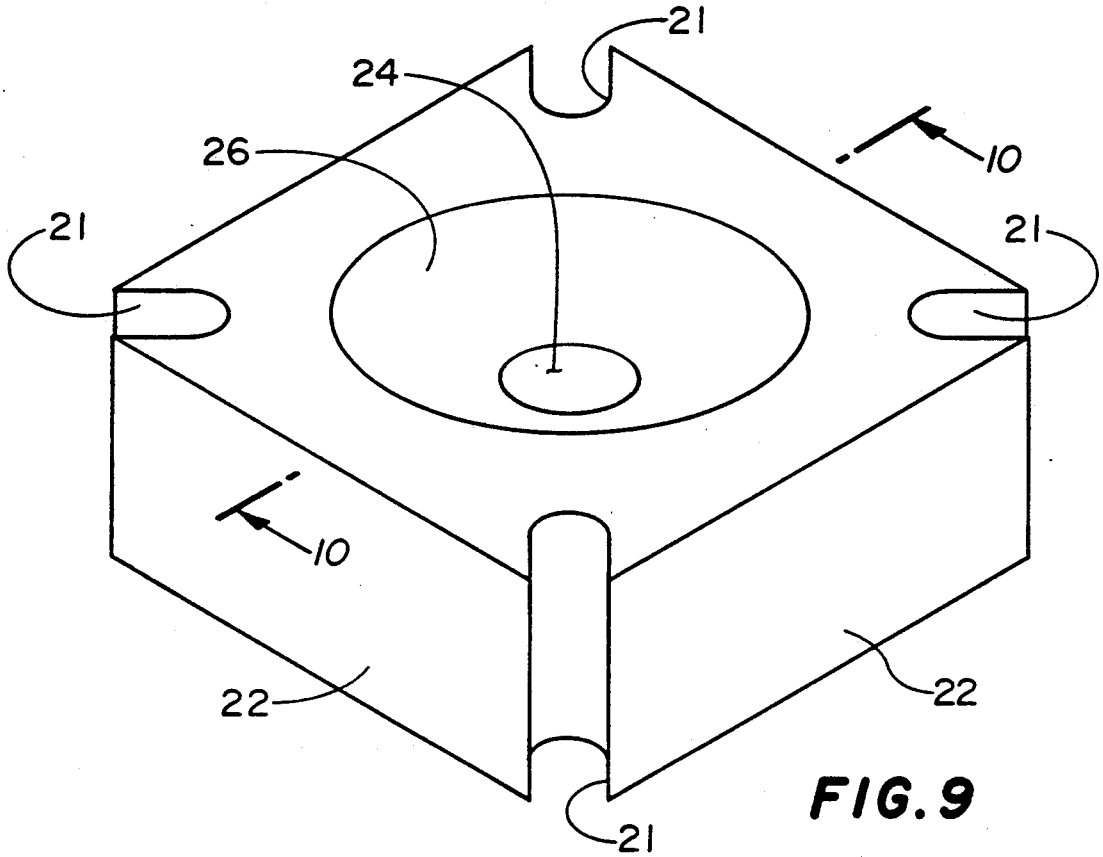
FIG. 9 is a perspective view of the peep sight of the present invention.
Figure 10:
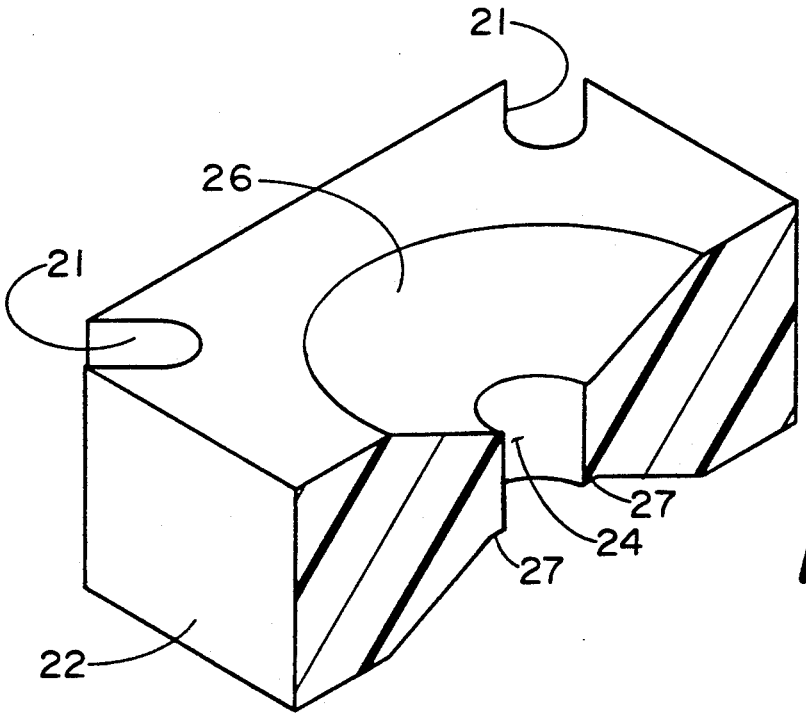
FIG. 10 is a cross-section taken across the lines 10—10 of FIG. 9.

The peep sight 14 of the present invention is a unitary article which can be mounted on any conventional archery bow 10, as seen in FIGS. 6-10, the bow not being the patentable feature of the present invention. The peep sight 14 preferably is a substantially square shape provided with four corners 20. Each corner has a slot 21 formed therein. Connecting each corner are substantially straight edges 22. The peep sight 24 further has two substantially flat, parallel faces 23 and a viewing window 24 is formed therebetween. The viewing window 24 is a peep hole which is formed substantially centrally of the peep sight 14. A pair of annular beveled surfaces 25, 26 join the viewing window 24 to the flat face 23 of the peep sight 14. The annular beveled surfaces 25, 26, reduce distortion when the sight is used. An annular ledge 27 is provided between the peep hole 24 and the first annular beveled surface 25. When the peep sight 14 is mounted in the bowstring 13, the annular ledge 27 is provided between the peep hole 24 and the first annular beveled surface 25. The annular ledge 27 is oriented toward the archer's eye. The annular ledge 27 further is provided with a pigment impregnation, preferably a black or dark shade. This may be hot stamped into the peep sight 14. The dark annular ledge 27 provides greater viewing definition, but since it is only approximately 0.0625 in. wide, it does not impair light transmission in the peep sight 14. As further shown in FIGS. 7 and 8, the viewing window 24 (or peep hole) may be substantially perpendicular to the flat faces 23 or it may be disposed at an angle to the flat faces 23. The latter configuration is preferred since, when the bowstring 13 is drawn, the peep sight 14 is disposed at an angle to the archer's face as shown in FIGS. 1-4. The annular orientation of the peep hole 24 (FIG. 8) provides a larger field of vision for the archer (FIG. 4).

Figure 11:
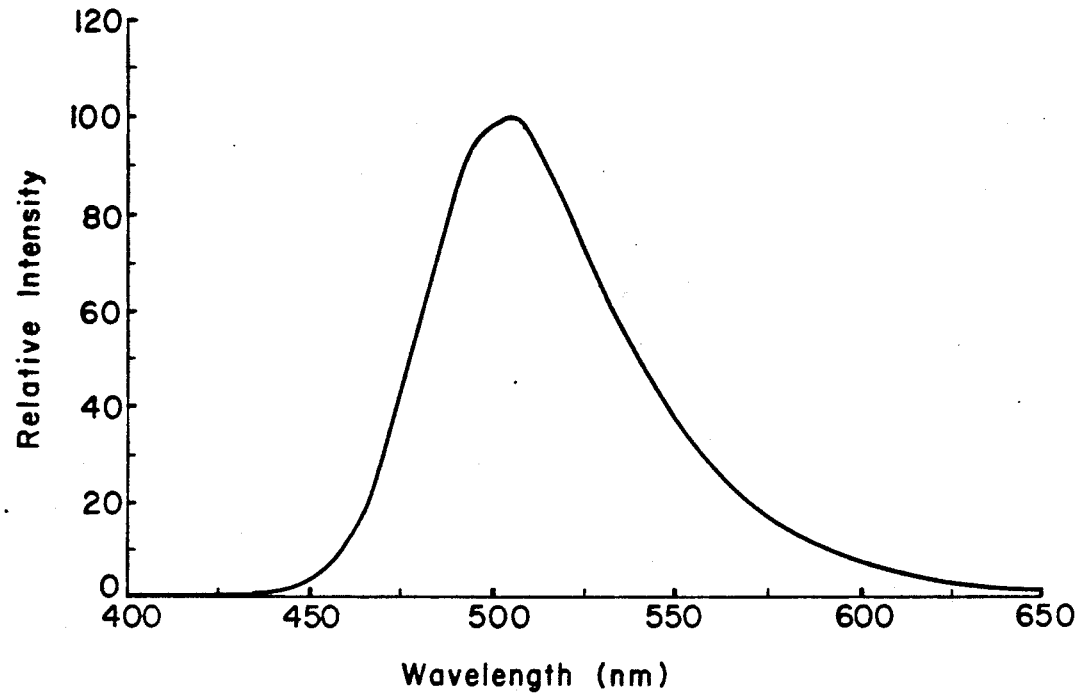
FIG. 11 is the emission spectrum of the dye excited at 390 nm.

The bowstring 13 is usually formed of a plurality of individual strands 30. The peep sight 14 of the present invention is mounted on the bowstring 13 by separating the strands 30 into four groups. One group is then disposed in the slots in each respective corner 21 of the peep sight 14. The strands 30 are rejoined at the respective savings 31 at either side of the peep sight 14 to reconstitute the single bowstring 13 (FIGS. 5 and 11). As more clearly shown in FIG. 5, the archer's view as seen through the peep sight, is unobstructed by the strands 30 of the bowstring 13 due to the strands 30 being separated onto the four corners of the peep sight 14. FIG. 5 also illustrates the ability of the archer to clearly see the sight pin 16 through the peep hole 24 with the annular beveled surface 25 permitting an undistorted view.

It is preferred that the peep sight 14 be made of a substantially transparent material such as a polycarbonate polymer. It has been found that "Lexan" ®, a polycarbonate available from General Electric Corp. may be used as a material of manufacture for the peep sight. This material is comparatively inexpensive and is easily tooled to the desired configuration. Furthermore, it can be hot stamped to form the annular ledge 27 and the pigmentation on the annular ledge may be added to this material. In addition, it is preferred that the peep sight have an additive added thereto to provide an additive of effect to focus the available light to the viewing window 24 such that the intensity of the light is brighter at edges of the viewing window. A material sold by General Electric Corp. under the name of "Neon" has been used satisfactorily to color the material used in the peep sight 14. This product is yellow-green in color but other colors may be used to provide the same effect. The effectiveness of the coloration is enhanced because the available light is absorbed at a first wave length and emitted at a second, more easily visible, wave length.

Figure 12:
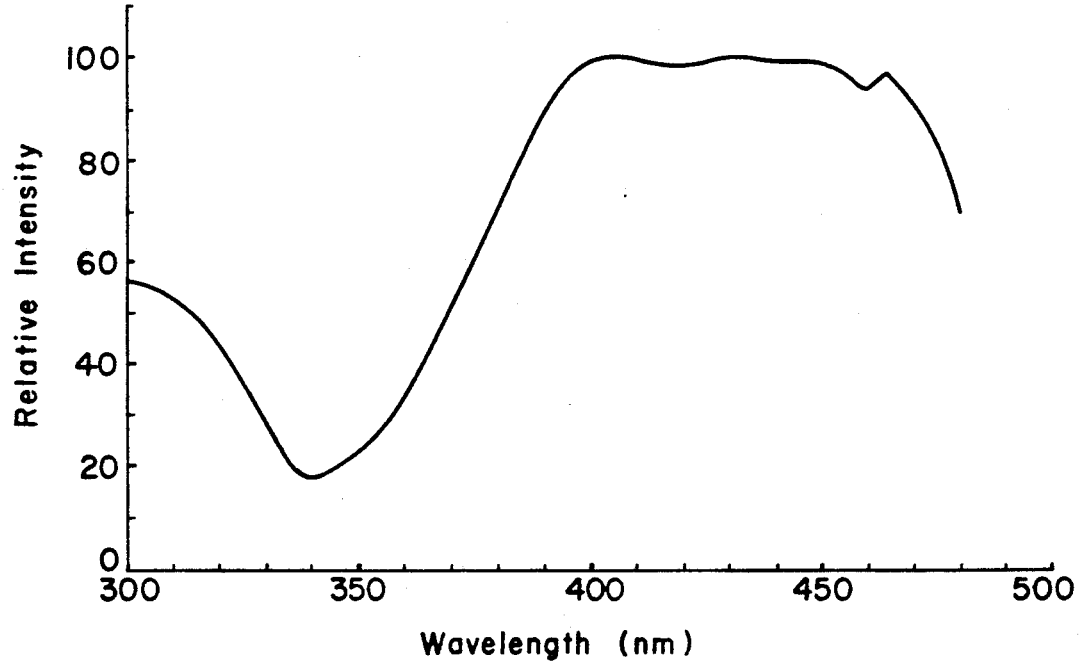
FIG. 12 is the excitation scan of the dye observed at 500 nm.
Figure 14:
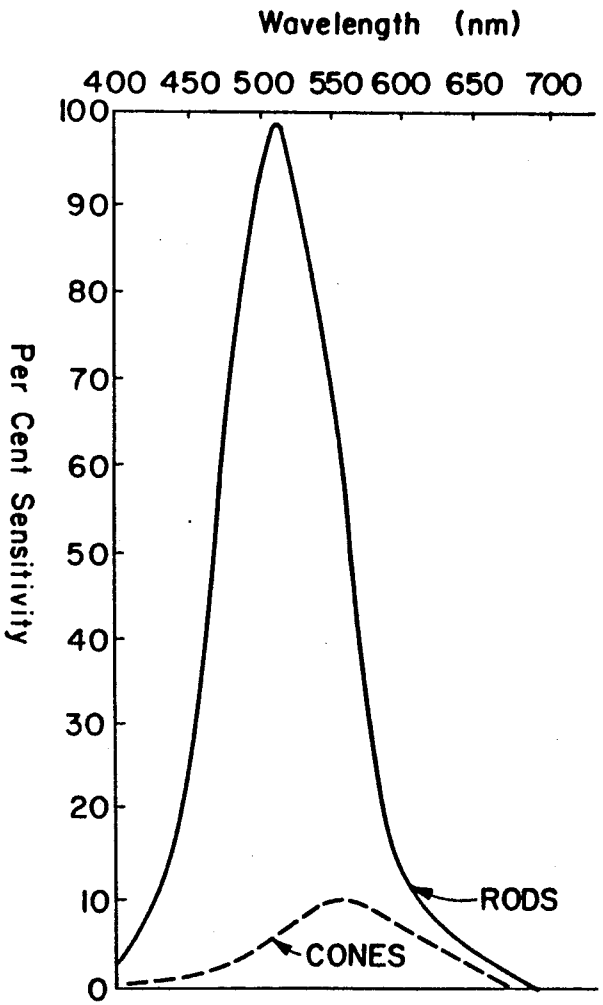
FIG. 14 shows the sensitivity of the human eye to light.
Figure 13:
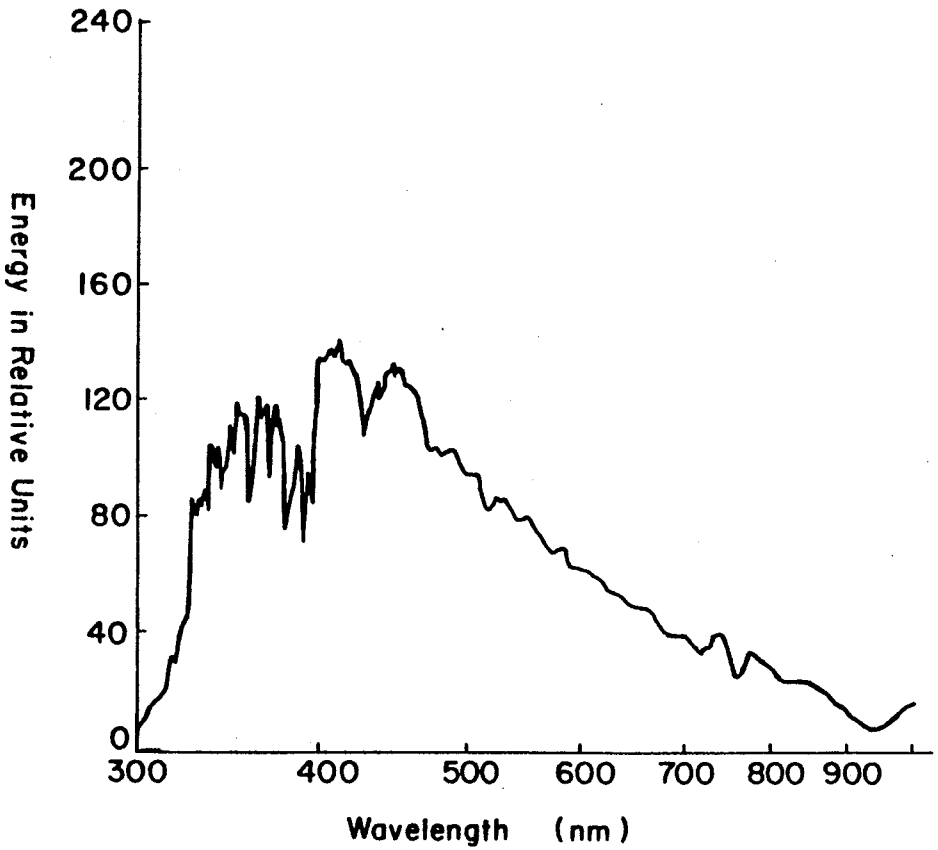
FIG. 13 is a graph of the spectral distribution of the sky.

In particular, the emission wave length of the dye in Lexan is shown in FIG. 11 with the maximum emission at approximately 505 nm. As shown in FIG. 12 the excitation of the dye in Lexan increases in the ultraviolet reaching a maximum at approximately 400 nm and decreasing at approximately 450 nm. The excitation scan was conducted with an observation wave length of 500 nm. The spectral distribution of diffuse radiation with clear skies at a point when sky luminance is minimal is shown in FIG. 13. At dawn and dusk, the ambient sky radiation contains an ultraviolet component and a component in the region of 400–450 mm. These components correspond to the excitation wave length of the dye. The response of the human eye is shown in FIG. 14 with the rods being most sensitive at approximately 510 nm and the cones being most sensitive at approximately 550 nm. Thus, the ambient radiation in the sky is the wave length which is optimum for excitation of the dye, especially the ultraviolet component which is invisible to the human eye and the near ultraviolet component (less than 450 nm) to which the human eye has poor sensitivity. The wave length of emission of the dye is the wave length to which the eye has the greatest sensitivity. In this manner, an effective increase in visibility is produced in the peep sight 14.

Figure 15:
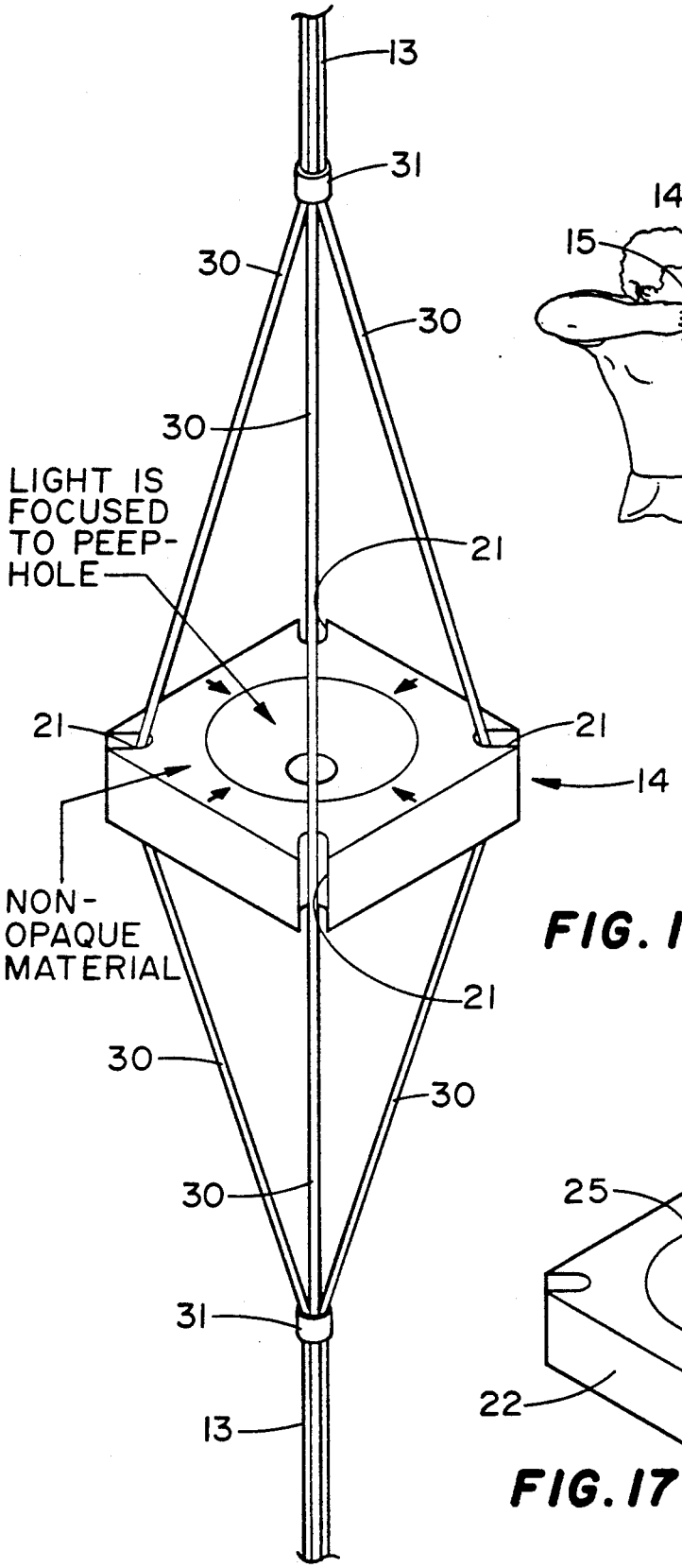
FIG. 15 is an enlarged perspective view of the peep sight of the present invention mounted in the strands of the bowstring.

Also, as is more clearly shown in FIG. 15, the light received in the peep sight 14 is focussed toward the peep hole 24 thereby permitting the archer to view through the peep sight 14 more efficiently when light levels are reduced.

Figure 16:
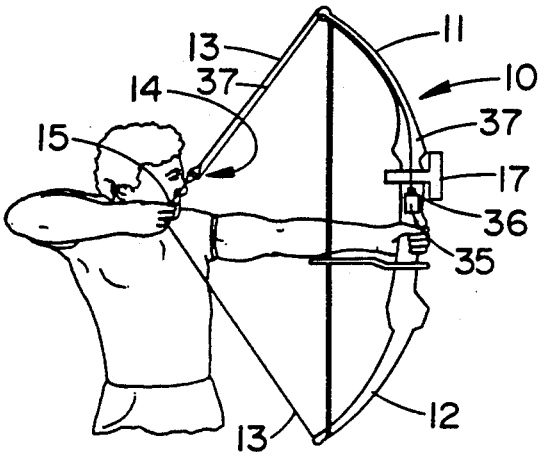
FIG. 16 is a perspective view of an archer using a bow on which is mounted the fiber optic embodiment of the present invention.
Figure 17:
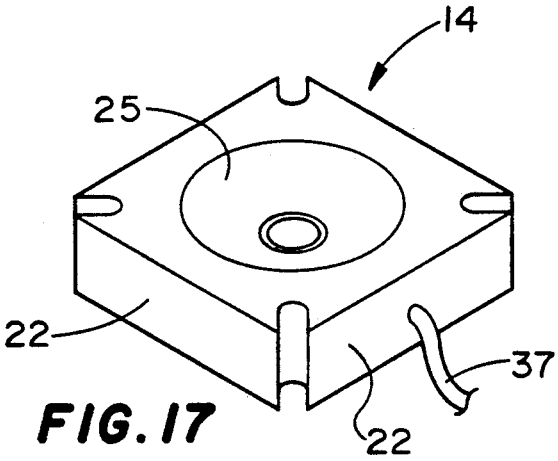
FIG. 17 is a perspective view of the peep sight of the present invention with the fiber optic cord attached thereto.

In an alternate embodiment, as shown in FIGS. 16 and 17, an energy source 35 such as battery is attached to the bow. Preferably the attachment is near the midpoint of the bow 10 close to the point where the archer's hand grips the bow 10. A light source 36 such as a small bulb is connected to the energy source 35 and, if desired, an on-off switch may also be electrically connected between the energy source 35 and the light source 36. Attached to the light source 36 is the first end of a fiber optic cord 37. The fiber optic cord 37 has a second end connected to the peep sight. When the light source 36 is energized, light is transmitted through the fiber optic cord 37 to the peep sight 14. The illuminated peep sight provides improved target definition for the archer.

The fiber optic cord 37 may be easily connected to the peep sight 14 as described in the present invention (FIG. 13). The light from the light source 36 entering the non-opaque peep sight is transmitted to the peep hole 24. The annular ledge 27 with the pigment impregnation provides greater viewing definition while preventing glare in the eye of the archer. Further enhancement of the viewing is produced by the additive to the peep sight which absorbs the light at a first wave length and emits the light at a second wave length. The additive is selected such that the wave length of emission is more easily visible than the wave length of absorption such that the light is intensified about the peep hole and visibility is enhanced.

In this manner, the present invention meets a longstanding need to improve the ability of an archer to use a peep sight when the light levels are low. The peep sight of the present invention is formed from a non-opaque material and has a light enhancing color added thereto for improved target definition. In addition, the notched four corner design enables the peep sight to be mounted on the bowstring so that the strands of the bowstring do not obstruct the vision of the archer. Furthermore, the peep hole in the peep sight may be angled so that a larger field of vision is provided to the archer. The use of the light source connected by a fiber optic cord to the peep sight further improves the visibility through the peep sight.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with an archer's bow having a pair of limb portions provided with a bowstring therebetween, the bowstring having at lest one strand, a peep sight comprising a unitary article made from a non-opaque material and having a viewing window formed therein, means for mounting the sight on the strand, the sight having a pair of substantially flat faces, the viewing window being formed between the flat faces, and the sight further having a pair of annular beveled surfaces, each beveled surface formed annularly surrounding the viewing window and extending outwardly therefrom in opposite directions, so that each beveled surface is formed joining the viewing window to the respective faces of the sight, thereby reducing distortion when the sight is used, the sight having means formed integrally therewith for transmitting the light entering the sight in towards the viewing window, such that the available light is transmitted towards the viewing window for improved viewing window definition, especially where the available light is substantially restricted.

2. In combination with an archer's bow having a pair of limb portions provided with a bowstring therebetween, the bowstring having at least one strand, a peep sight comprising a unitary article made from a non-opaque material and having a viewing window formed therein, means for mounting the sight on the strand, the sight having a pair of substantially flat faces and further having a pair of annular beveled surfaces joining the viewing window to the respective faces of the sight, thereby reducing distortion when the sight is used, the sight having means formed integrally therewith for transmitting the light entering the sight in towards the viewing window, such that the available light is transmitted towards the viewing window for improved viewing window definition, especially where the available light is substantially restricted, wherein the viewing window comprises a peep hole formed substantially centrally of the sight and between the faces thereof.

3. The combination of claim 2, wherein the sight is provided with an annular ledge between the peep hole and one of the annular beveled surfaces on the sight, and wherein the annular ledge is provided with a pigment implementation.

4. The combination of claim 3, wherein the pigment impregnation on the annular wall of the peep hole is formed by a hot stamp.

5. In combination with an archer's bow having a pair of limb portions provided with a bowstring therebetween, the bowstring having at least one strand, a peep sight comprising a unitary article made from a non-opaque material and having a viewing window formed therein, means for mounting the sight on the strand, the sight having a pair of substantially flat faces, the viewing window being formed between the flat faces, and the sight further having a pair of annular beveled surfaces, each beveled surface formed annularly surrounding the viewing window and extending outwardly therefrom in opposite directions, so that each beveled surface is formed joining the viewing window to the respective faces of the sight, thereby reducing distortion when the sight is used, the sight having means formed integrally therewith for transmitting the light entering the sight in towards the viewing window, such that the available light is transmitted towards the viewing window for improved viewing window definition, especially where the available light is substantially restricted, wherein the sight is substantially transparent.

6. In combination with an archer's bow having a pair of limb portions provided with a bowstring therebetween, the bowstring having at least one strand, a peep sight comprising a unitary article made from a non-opaque material and having a viewing window formed therein, means for mounting the sight on the strand, the sight having a pair of substantially flat faces, the viewing window being formed between the flat faces, and the sight further having a pair of annular beveled surfaces, each beveled surface formed annularly surrounding the viewing window and extending outwardly therefrom in opposite directions, so that each beveled surface is formed joining the viewing window to the respective faces of the sight, thereby reducing distortion when the sight is used, the sight having means formed integrally therewith for transmitting the light entering the sight in towards the viewing window, such that the available light is transmitted towards the viewing window for improving viewing window definition, especially where the available light is substantially restricted, wherein the sight is made from a polycarbonate material.

7. In combination with an archer's bow having a pair of limb portions provided with a bowstring therebetween, the bowstring having at least one strand, a peep sight comprising a unitary article made from a non-opaque material and having a viewing window formed therein, means for mounting the sight on the strand, the sight having a pair of substantially flat faces and further having a pair of annular beveled surfaces joining the viewing window to the respective faces of the sight, thereby reducing distortion when the sight is used, the sight having means formed integrally therewith for transmitting the light entering the sight in towards the viewing window, such that the available light is transmitted towards the viewing window for improved viewing window definition, especially where the available light is substantially restricted, wherein the sight is substantially square and is provided with four corners, each of which have a slot formed therein, and wherein the bowstring has at least four strands, one for each slot, thereby permitting mounting the sight on the strands.

8. The combination of claim 7, wherein the square sight has substantially straight edges, thereby enhancing the absorption of the available light into the viewing window.

9. The combination of claim 7, wherein the sight has a color added therein, whereby a fiber optical effect is provided to focus the available light to the viewing window, and whereby the intensity of the color of the sight is brighter at the respective edges of the viewing window.

10. In combination with an archer's bow having a pair of limb portions provided with a bowstring therebetween, the bowstring having at least one strand, a peep sight comprising a unitary article made from a non-opaque material and having a viewing window formed therein, means for mounting the sight on the strand, the sight having a pair of substantially flat faces, the viewing window being formed between the flat faces, and the sight further having a pair of annular beveled surfaces, each beveled surface formed annularly surrounding the viewing window and extending outwardly therefrom in opposite directions, so that each beveled surface is formed joining the viewing window to the respective faces of the sight, thereby reducing distortion when the sight is used, the sight having means formed integrally therewith for transmitting the light entering the sight in towards the viewing window, such that the available light is transmitted towards the viewing window for improved viewing window definition, especially where the available light is substantially restricted, wherein the pair of flat faces are substantially parallel to one another and the viewing window is disposed at an angle to the flat faces such that an increased viewing area is available.

11. In combination with an archer's bow having a pair of limb portions provided with a bowstring therebetween, a peep sight comprising a unitary article made from a substantially transparent non-opaque material and having a viewing window formed therein, the sight being substantially square and provided with four corners, each corner having a slot formed therein, wherein the bowstring has at least four strands, one strand being received in each slot, thereby permitting mounting the sight on the bowstring; the sight having a pair of substantially flat faces and further having a pair of annular beveled surfaces joining the viewing window to the respective faces of the sight, thereby reducing distortion when the sight is used, the viewing window comprising a peep hole formed substantially centrally of the sight and between the faces thereof, the sight being provided with an annular ledge between the peep hole and one of the annular beveled surfaces o the sight, the annular ledge being provided with a pigment impregnation and the sight having means formed integrally therewith for transmitting the light entering the sight in towards the viewing window, such that the available light is transmitted towards the viewing window for improved viewing window definition, especially where the available light is substantially restricted.

12. A peep sight used in combination with an archer's bow, the archer's bow having limb portions, a bowstring extending between the limb portions, wherein the peep sight is mounted on the bowstring, the peep sight comprising a unitary article having a pair of flat faces, the faces being substantially parallel to one another, a peep hole formed substantially centrally of the peep sight and between the faces thereof, the peep sight being substantially transparent and having an additive therein, the additive absorbing the available light at a first wave length and emitting light at a second wave length thereby intensifying the light about the peep hole.

13. The peep sight of claim 12, wherein the additive added to the peep sight is yellow-green.

14. The peep sight of claim 12, wherein the additive added to the peep sight is a fluorescent color.

15. A peep sight used in combination with an archer's bow, the archer's bow having limb portions, a bowstring extending between the limb portions, the peep sight comprising a unitary article made from a non-opaque material and having a viewing window formed therein, means for mounting the peep sight on the bowstring; a source of energy connected to the bow, a light source connected to the source of energy, a fiber optic cord having a first end and a second end, the first end of the fiber optic cord being attached to the peep sight, the second end of the fiber optic cord being attached to the light source such that when the light source is energized, light is transmitted through the fiber optic cord to illuminate the peep sight for improved viewing window definition.

16. The peep sight of claim 15, wherein the peep sight has a pair of substantially flat faces and further has a pair of annular beveled surfaces joining the viewing window to the respective faces of the peep sight, thereby reducing distortion when the sight is used.

17. The peep sight of claim 15, wherein the viewing window comprises a peep hole formed substantially centrally of the sight and between the faces thereof.

18. The peep sight of claim 17, wherein the sight is provided with an annular ledge between the peep hole and one of the annular beveled surfaces on the sight, and wherein the annular ledge is provided with a pigment impregnation.

19. The peep sight of claim 18, wherein the pigment impregnation on the annular wall of the peep hole is formed by a hot stamp.

20. The peep sight of claim 15, wherein the sight is substantially transparent.

21. The peep sight of claim 15, wherein the sight is made from a polycarbonate material.

22. The peep sight of claim 15, wherein the sight is substantially square and is provided with four corners, each of which has a slot formed therein, and wherein the bowstring has at least four strands, one strand being received in each slot, thereby permitting mounting the sight on the bowstring.

23. The peep sight of claim 15, further comprising the peep sight having an additive therein, the additive absorbing the light from the light source at a first wave length and emitting light at a second wave length, thereby intensifying the light about the peep hole.

* * * * *